US011053052B2

(12) United States Patent
Lee

(10) Patent No.: US 11,053,052 B2
(45) Date of Patent: Jul. 6, 2021

(54) STORAGE CONTAINER WITH STOPPER STRUCTURE

(71) Applicant: Cheng-Tai Lee, Tainan (TW)

(72) Inventor: Cheng-Tai Lee, Tainan (TW)

( * ) Notice: Subject to any disclaimer, the term of this patent is extended or adjusted under 35 U.S.C. 154(b) by 151 days.

(21) Appl. No.: 16/429,274

(22) Filed: Jun. 3, 2019

(65) Prior Publication Data

US 2020/0377267 A1 Dec. 3, 2020

(51) Int. Cl.
*B65D 43/16* (2006.01)
*B65D 51/18* (2006.01)

(52) U.S. Cl.
CPC ..... *B65D 43/161* (2013.01); *B65D 51/18* (2013.01); *B65D 2543/005* (2013.01); *B65D 2543/0025* (2013.01); *B65D 2543/00194* (2013.01); *B65D 2543/00379* (2013.01); *B65D 2543/00537* (2013.01); *B65D 2543/00555* (2013.01); *B65D 2543/00648* (2013.01); *B65D 2543/00685* (2013.01); *B65D 2543/00722* (2013.01); *B65D 2543/00805* (2013.01)

(58) Field of Classification Search
CPC ..... B65D 51/18; B65D 43/161; B65D 43/16
USPC ... 220/254.6, 254.3, 254.2, 254.1, 826, 832, 220/831
See application file for complete search history.

(56) References Cited

U.S. PATENT DOCUMENTS 4,336,915 A 6/1982 Stoecklin et al.
4,369,901 A 1/1983 Hidding
4,723,693 A * 2/1988 DeCoster ..... B65D 47/0876 222/483
6,575,323 B1 * 6/2003 Martin ..... B65D 47/0852 220/254.2
7,150,380 B2 * 12/2006 Hoepner ..... B65D 43/161 222/480
7,165,695 B2 1/2007 Choi
8,448,804 B2 * 5/2013 Luburic ..... B65D 43/161 220/270
8,517,212 B2 * 8/2013 Antal, Sr. ..... B65D 43/161 220/832
2017/0267419 A1 * 9/2017 Del Rosario Roy .. B65D 55/02
2019/0223499 A1 * 7/2019 Ouyang ..... A24F 40/40
2020/0198849 A1 * 6/2020 Chen ..... B65D 43/161

* cited by examiner

*Primary Examiner* — Robert J Hicks
(74) *Attorney, Agent, or Firm* — Rosenberg, Klein & Lee

(57) ABSTRACT

A storage container includes a container body and a lid that has a first lid portion, a second lid portion, and a hinge portion between the first and second lid portions. Two sides of the hinge portion are formed with a first inclined surface connected to the first lid portion and a second inclined surface connected to the second lid portion, respectively. The first inclined surface is provided with at least one first engaging unit. An outer wall surface of the first engaging unit has a first stopper. The first stopper is parallel to or perpendicular to a horizontal plane of the lid. The second inclined surface is provided with at least one second engaging unit. An inner wall surface of the second engaging unit has a second stopper. The second stopper is perpendicular to or parallel to the horizontal plane, and is perpendicular to the first stopper.

13 Claims, 9 Drawing Sheets

STORAGE CONTAINER WITH STOPPER STRUCTURE

FIELD OF THE INVENTION

The present invention relates to a container, and more particularly to a storage container having a lid. The lid has a first lid portion and a second lid portion that are engagable with each other.

BACKGROUND OF THE INVENTION

A conventional storage container is usually provided with a lid that can be opened at both ends in order to take the objects in the container conveniently. For example, U.S. Pat. No. 4,336,915 published on Jan. 4, 1983 discloses a hinged lid container, comprising a lid. The lid has two lid portions and a hinge portion between the two lid portions. Either side of the hinge portion is provided with an inclined surface. Through the inclined surface, each lid portion is pivotable about the hinge portion so as to open the lid. However, after the two lid portions are pivoted and opened, there is no structure for holding the lid portions. Therefore, after one of the lid portions is opened, the lid portion cannot be positioned, and it is necessary to hold the lid portion with the user's hand. It is quite inconvenient for use.

U.S. Pat. No. 4,369,901 published on Jan. 25, 1983 discloses a snap-up cover for spice dispenser, comprising a lid. The lid has two lid portions and a hinge portion between the two lid portions. One of the lid portions is provided with a protrusion that is engageable in a recess of the other lid portion to form an engagement. The configuration of the protrusion and the recess is quite troublesome for production, especially after the mold is opened, which causes difficulty in demolding. Sometimes, the protrusion and the recess may be damaged.

U.S. Pat. No. 7,165,695 published on Jan. 23, 2007 discloses a dispensing container for dispensing fasteners, comprising a lid. The lid has two lid portions and a hinge portion between the two lid portions. One of the lid portions is provided with a convex portion having a plurality of inclined surfaces, and the other lid portion is provided with a concave portion having a plurality of inclined surfaces. The convex portion is engaged in the concave portion, through the friction generated between the plurality of inclined surfaces, to form an engagement. Through the friction to form an engagement, the inclined surfaces will suffer a lot of wear and tear after a period of time. As a result, the friction is lost, unable to form an engagement, so it is not ideal in use.

SUMMARY OF THE INVENTION

In view of the above shortcomings of the conventional storage container, the primary object of the present invention is to provide a storage container. The storage container comprises a container body and a lid. The container body has an accommodating space therein. The lid is configured to cover the container body. The lid has a raised first lid portion, a raised second lid portion, and a hinge portion between the first lid portion and the second lid portion. Two sides of the hinge portion are formed with a first inclined surface and a second inclined surface, respectively. The first inclined surface is connected to the first lid portion. The second inclined surface is connected to the second lid portion. The first lid portion and the second lid portion are pivotable about the hinge portion as an axis, enabling the first inclined surface and the second inclined surface to lean against each other. The first inclined surface is provided with at least one first engaging unit. An outer wall surface of the first engaging unit is provided with a first stopper. The second inclined surface is provided with at least one second engaging unit corresponding to the first engaging unit. An inner wall surface of the second engaging unit is provided with a second stopper. The second stopper is perpendicular to the first stopper.

According to the above technical features, the following effects can be achieved:

1. The first stopper of the first engaging unit and the second stopper of the second engaging unit are engagable with each other, so that the first lid portion or the second lid portion can be secured conveniently. The lid can be opened or closed quickly.

2. The lid is provided with a hook having a wavy surface. When the hook is pulled by the user's finger, the wavy surface is configured to increase the frictional resistance to prevent the finger from slipping, such that the hook can be pulled stably.

3. One side of the container body is provided with a plurality of mating blocks. The peripheral edge of the lid is provided with a plurality of mating slots corresponding to the mating blocks. The mating slots are configured to receive the mating blocks, so that the lid can be easily assembled to or disassembled from the container body.

4. The overall structure is simple, and it is quite easy to manufacture. After the mold is opened, it does not cause difficulty in demolding. Each structure won't be damaged by demolding, which is beneficial for mass production.

DETAILED DESCRIPTION OF THE PREFERRED EMBODIMENTS

Embodiments of the present invention will now be described, by way of example only, with reference to the accompanying drawings.

Figure 1:
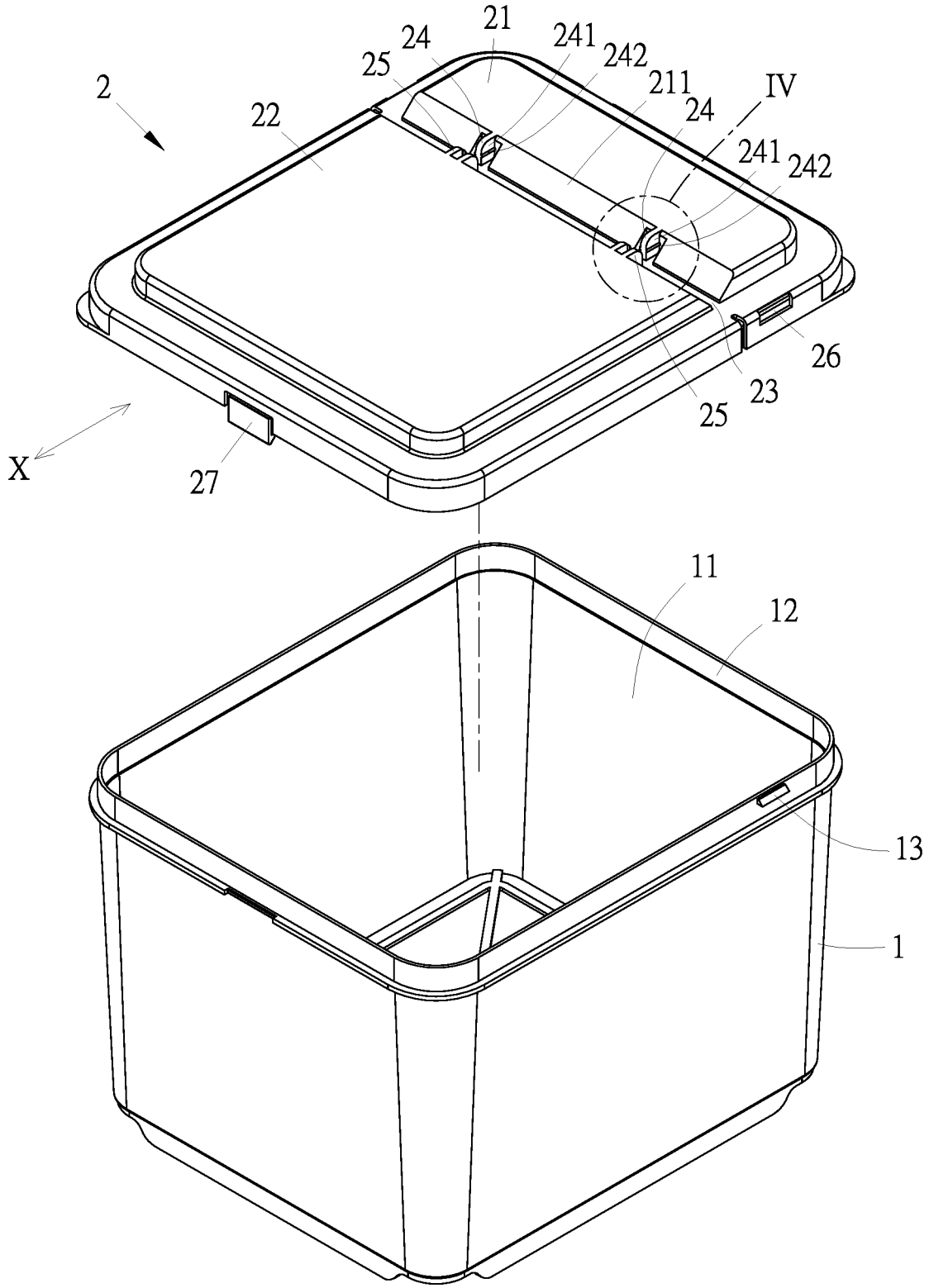
FIG. 1 is an exploded view in accordance with an embodiment of the present invention.
Figure 2:
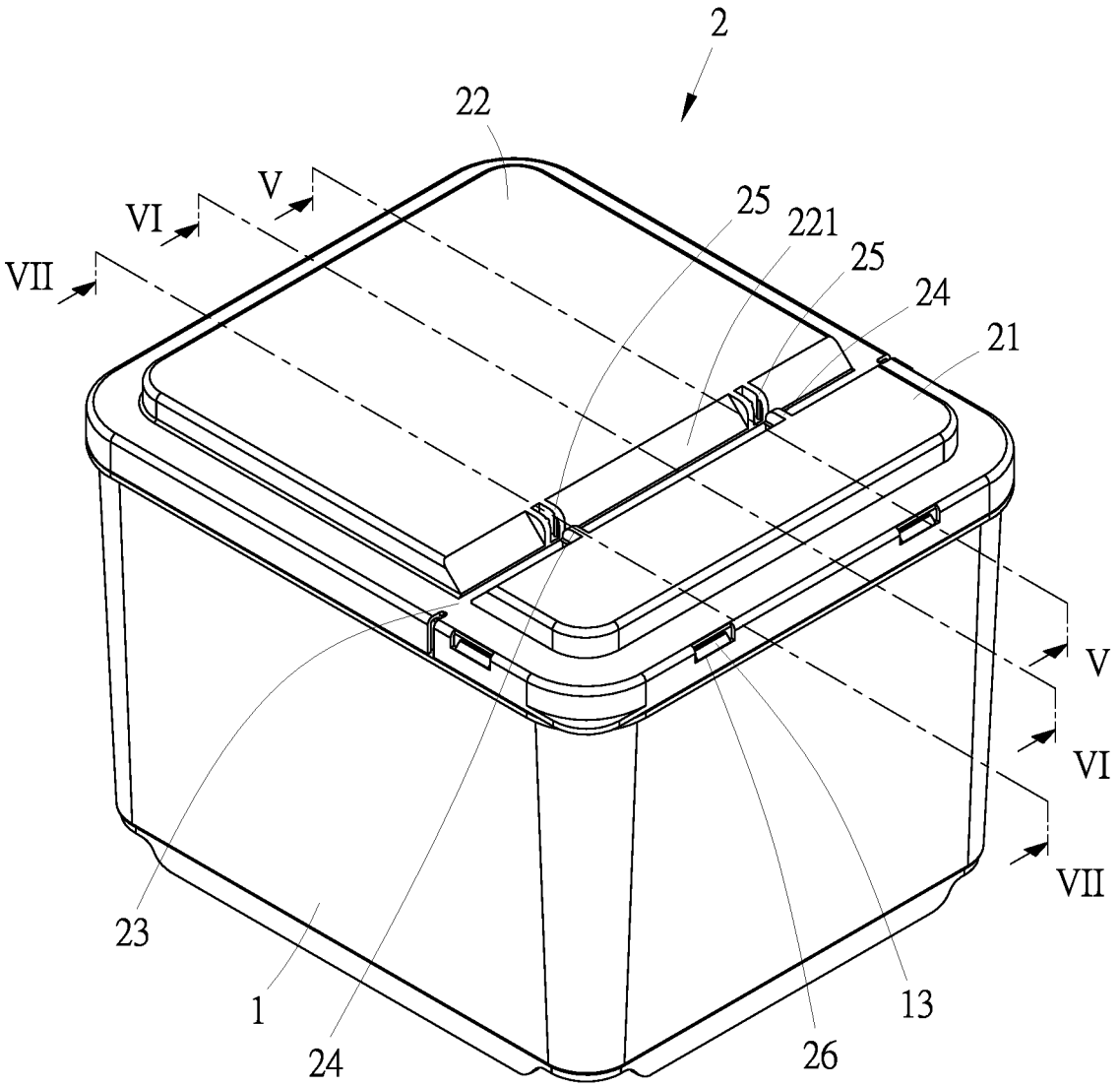
FIG. 2 is a perspective view in accordance with an embodiment of the present invention.

Referring to FIG. 1 and FIG. 2, a storage container in accordance with an embodiment of the present invention comprises a container body (1) and a lid (2).

The container body (1) has an accommodating space (11) therein. The periphery of the container body (1) is provided with a flange (12) close to an upper end of the container body (1). One side of the container body (1) is provided with a plurality of mating blocks (13) above the flange (12).

Figure 3:
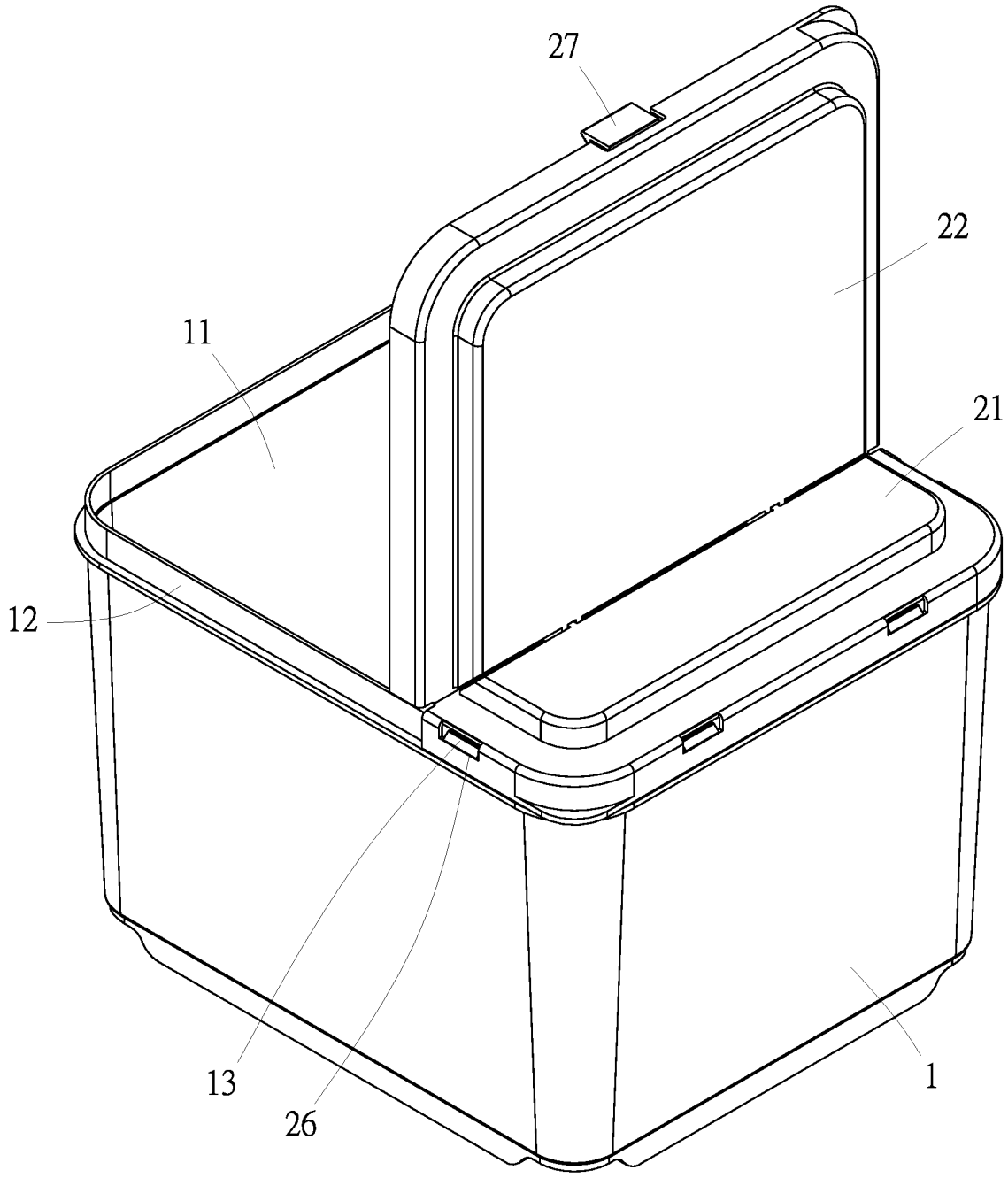
FIG. 3 is a schematic view in accordance with an embodiment of the present invention, showing that the second lid portion is secured.
Figure 4:
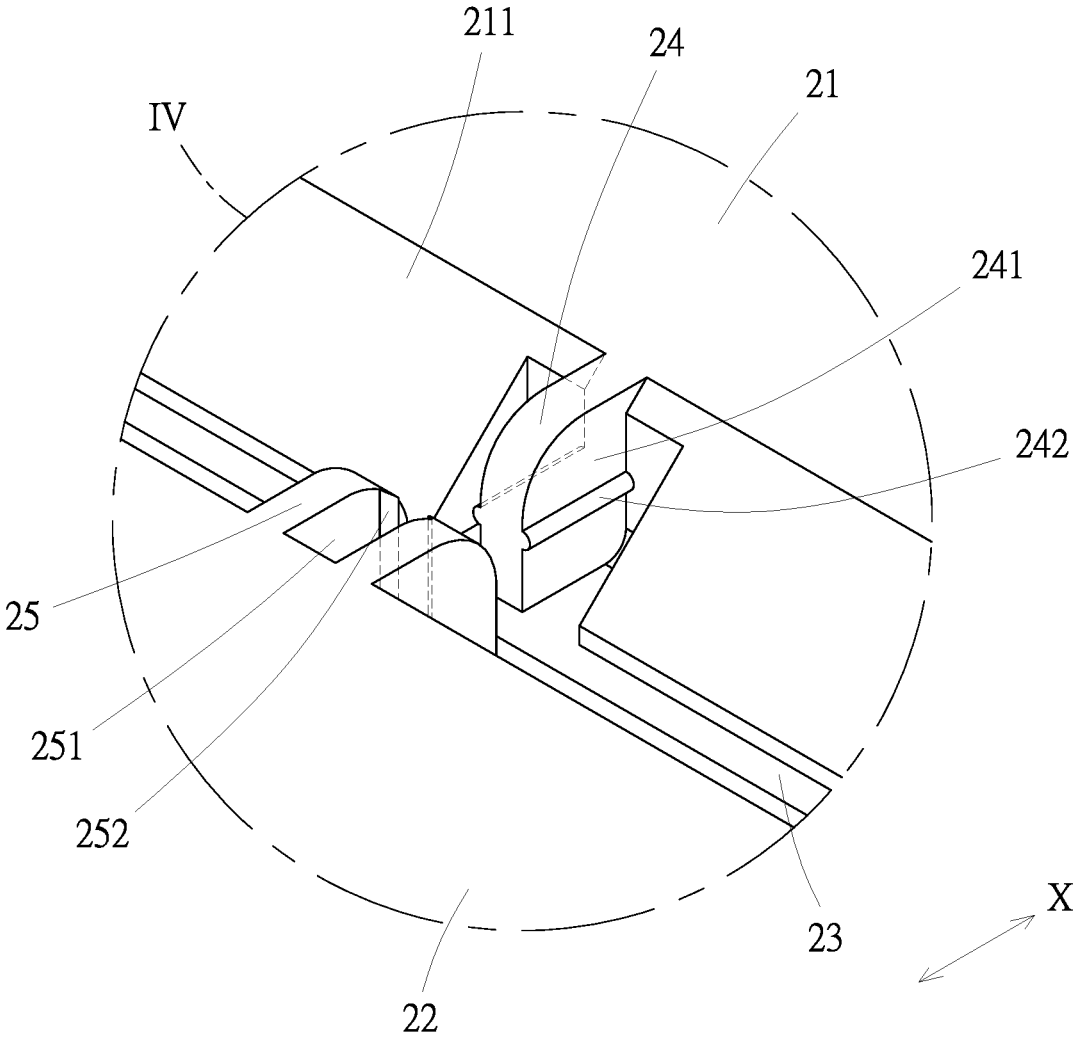
FIG. 4 is an enlarged view of circle IV of FIG. 1.
Figure 5:
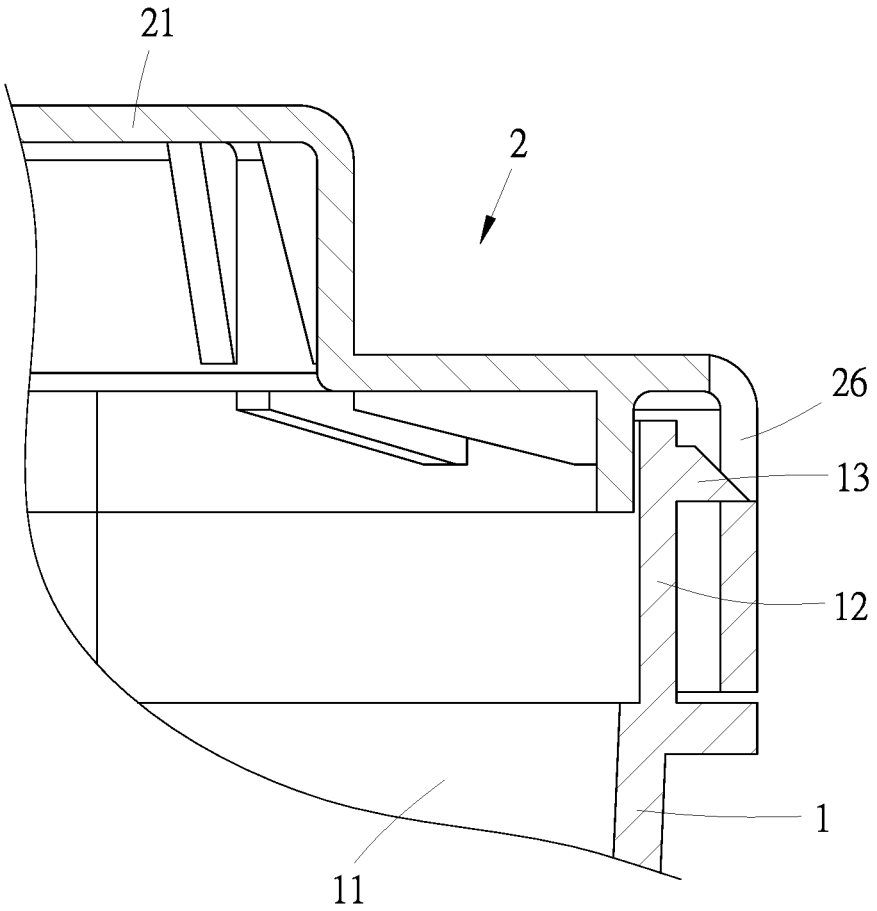
FIG. 5 is a partial cross-sectional view taken along line V-V of FIG. 2.
Figure 6:
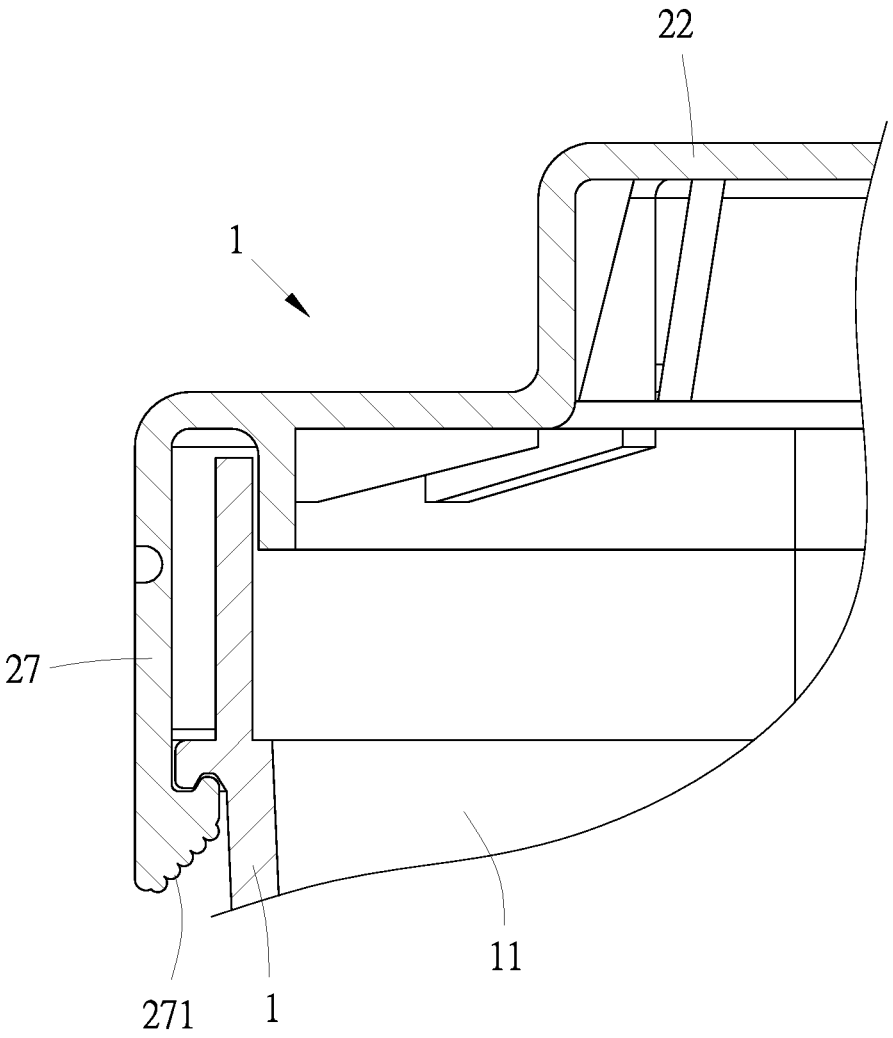
FIG. 6 is a partial cross-sectional view taken along line VI-VI of FIG. 2.

The lid (2) covers the container body (1) to close the accommodating space (11). The lid (2) has a raised first lid portion (21), a raised second lid portion (22), and a hinge portion (23) between the first lid portion (21) and the second lid portion (22). Two sides of the hinge portion (23) are formed with a first inclined surface (211) and a second inclined surface (221), respectively. The first inclined surface (211) is connected to the first lid portion (21), and the second inclined surface (221) is connected to the second lid portion (22). The first lid portion (21) and the second lid portion (22) are pivotable about the hinge portion (23) as an axis (as shown in FIG. 3), enabling the first inclined surface (211) and the second inclined surface (221) to lean against each other. The first inclined surface (211) is provided with two first engaging units (24) that are spaced apart from each other. The first engaging unit (24) is an engaging block. A first stopper (242) is disposed on the outer wall surface (241) of either side of the first engaging unit (24) (as shown in FIG. 4). The first stopper (242) is parallel to a horizontal plane (X) of the lid (2). The horizontal plane (X) refers to a horizontal reference plane on which the lid (2) is placed to cover the container body (1). The first stopper (242) may be perpendicular to the horizontal plane (X) of the lid (2) (not shown). The second inclined surface (221) is provided with two second engaging units (25) corresponding in position to the two first engaging units (24). The second engaging unit (25) is an engaging groove. A second stopper (252) is disposed on the inner wall surface (251) of either side of the second engaging unit (25) (as shown in FIG. 4). The second stopper (252) is perpendicular to the horizontal plane (X). The second stopper (252) is perpendicular to the first stopper (242). The second stopper (252) may be parallel to the horizontal plane (X) (not shown). The peripheral edge of the lid (2) is provided with a plurality of mating slots (26) corresponding in position to the mating blocks (13). The mating slots (26) are configured to receive the mating blocks (13), respectively (as shown in FIG. 5). A hook (27) protrudes from the bottom of the peripheral edge of the lid (2). The hook (27) is configured to catch the underside of the flange (12) (as shown in FIG. 6). The hook (27) has a wavy surface (271). When the hook (27) is pulled by the user's finger, the wavy surface (271) is configured to increase the frictional resistance so as to prevent the finger from slipping.

When in use, as shown in FIG. 1 and FIG. 2, the object to be stored (not shown) can be placed into the accommodating space (11) of the container body (1), and then the lid (2) covers the top of the container body (1). The mating blocks (13) of the container body (1) are engaged in the mating slots (26) on the periphery of the lid (2), respectively (as shown in FIG. 5). The hook (27) of the lid (2) catches the underside of the flange (12) (as shown in FIG. 6), so that the lid (2) is secured to the container body (1) to close the accommodating space (11).

Figure 7:
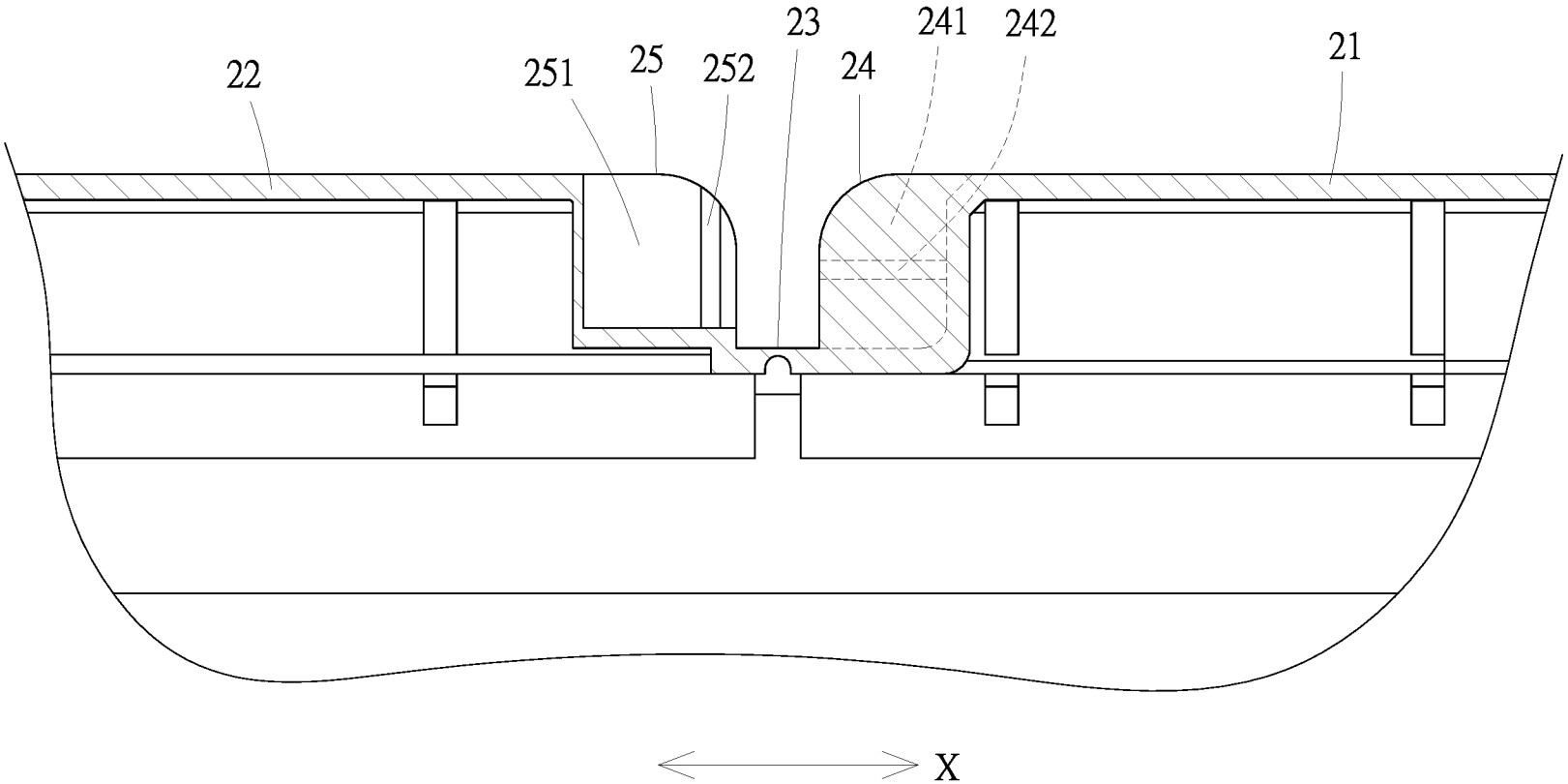
FIG. 7 is a partial cross-sectional view taken along line VII-VII of FIG. 2.
Figure 8:
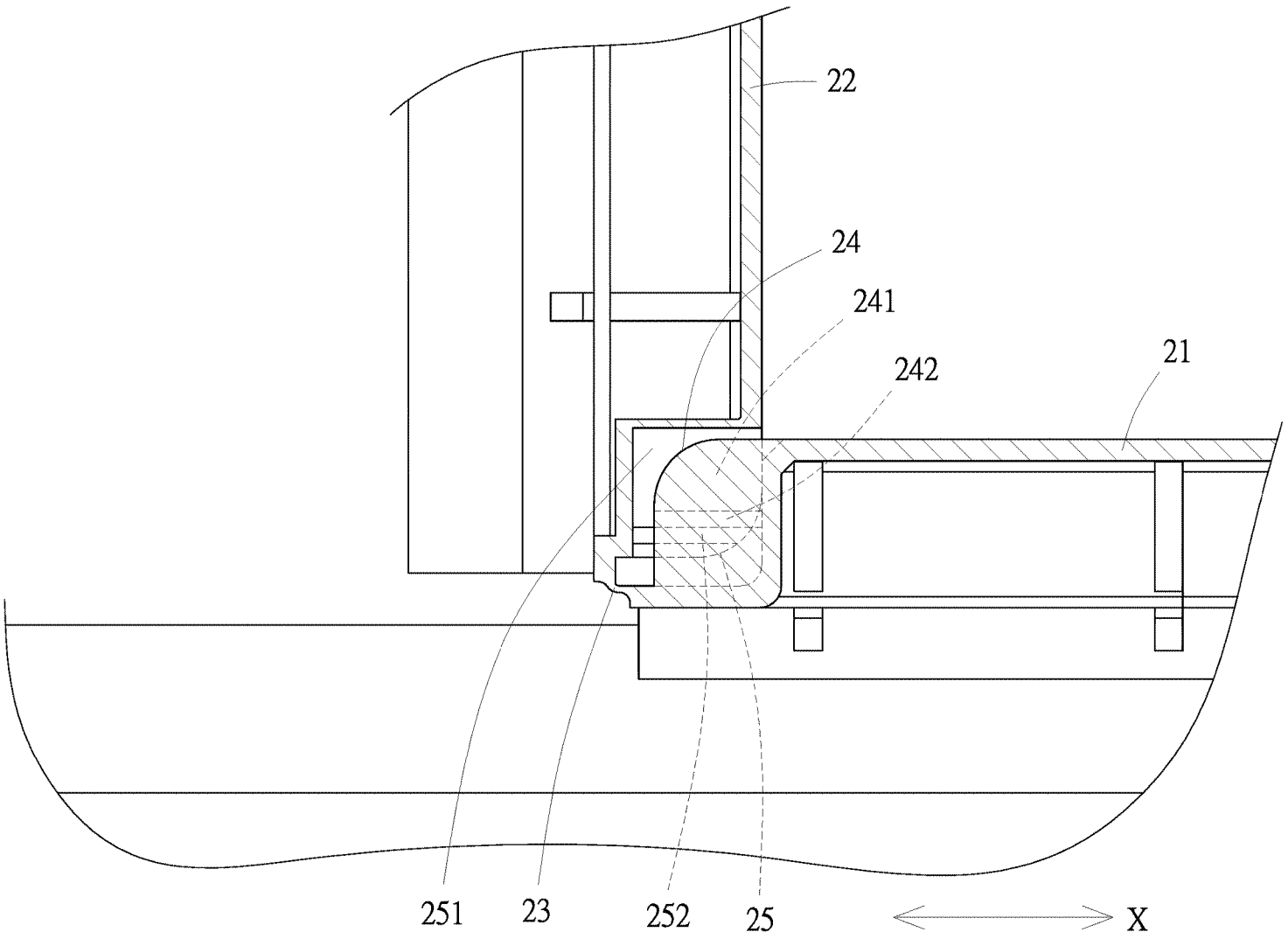
FIG. 8 is a schematic view in accordance with an embodiment of the present invention, showing that the second lid portion is pivoted upwardly and the first engaging unit is engaged with the second engaging unit.

When it is necessary to open the lid (2) to take the object in the accommodating space (11) out, as shown in FIG. 3 and FIG. 4, the user's finger (not shown) pulls the hook (27) to disengage from the flange (12) of the container body (1), so that the second lid portion (22) can be opened. The second lid portion (22) is pivoted in the direction of the first lid portion (21) with the hinge portion (23) as the axis, and the first inclined surface (211) of the first cover portion (21) leans against the second inclined surface (221) of the second lid portion (22), and the two second engaging units (25) are correspondingly engaged with the two first engaging units (24). In the beginning, the second stoppers (252) of the two second engaging units (25) are perpendicular to the horizontal plane (X) (as shown in FIG. 7), when the second stoppers (252) are pivoted along with the second lid portion (22) in the direction of the first lid portion (21), the second stoppers (252) become parallel to the horizontal plane (X), and the first stoppers (242) elastically push the inner wall surfaces (251) on the two sides of the two second engaging units (25), so that the second stoppers (252) can pass through the first stoppers (242). The inner wall surfaces (251) on the two sides can be elastically restored, so that the second stoppers (252) are confined at a position below the first stoppers (242) (as shown in FIG. 8) and won't be disengaged. At this time, both the first stoppers (242) and the second stoppers (252) are parallel to the horizontal plane (X). Therefore, the second lid portion (22) is secured to the first lid portion (21), and the accommodating space (11) of the container body (1) is opened for the user to take the object in the accommodating space (11) out.

Figure 9:
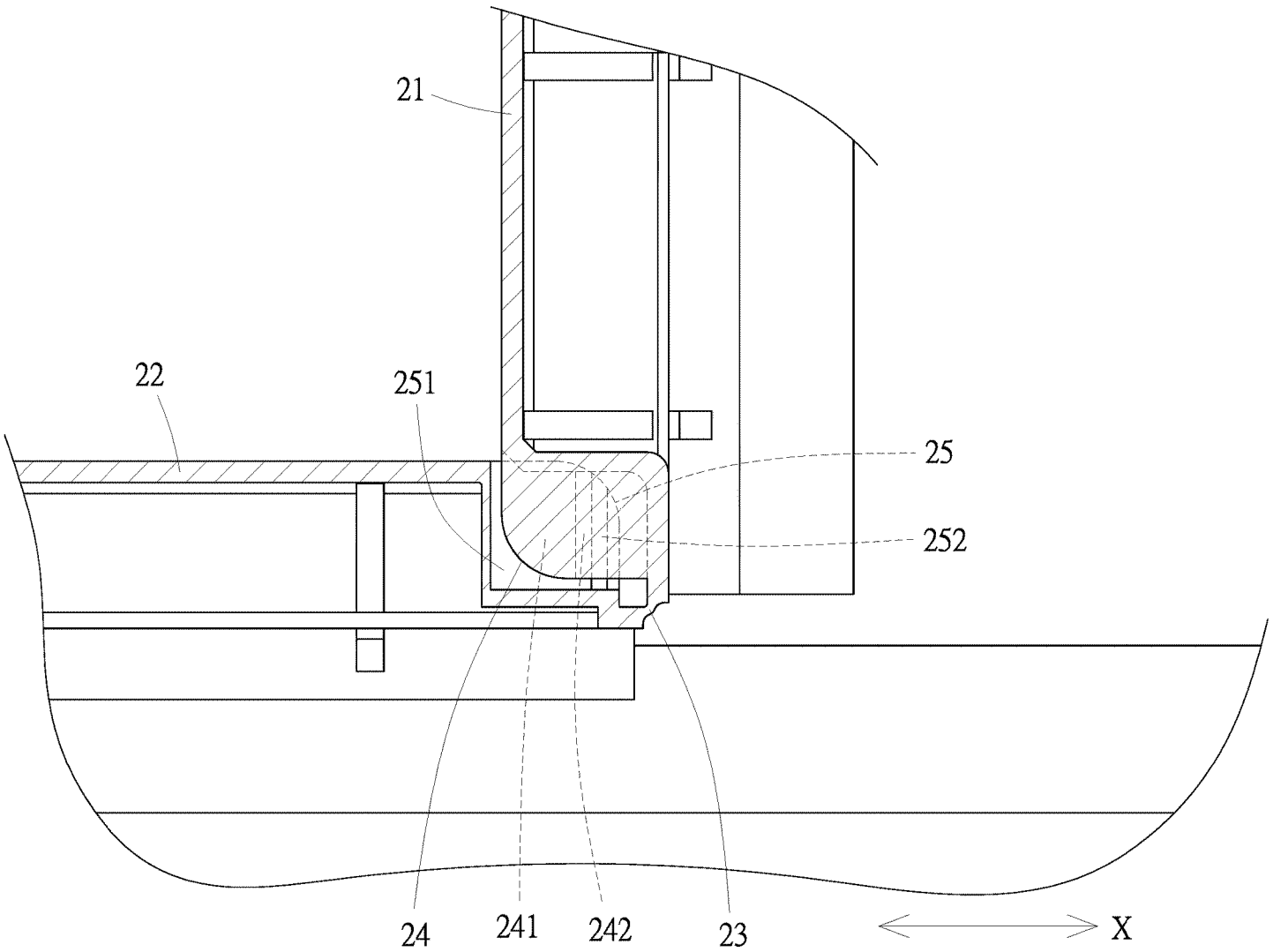
FIG. 9 is a schematic view in accordance with an embodiment of the present invention, showing that the first lid portion is pivoted upwardly and the first engaging unit is engaged with the second engaging unit.

FIG. 9 illustrates another use state of the present invention. The first lid portion (21) is opened, and then the first lid portion (21) is pivoted in the direction of the second lid portion (22), so that the first stoppers (242) are confined at the inner sides of the second stoppers (252) and won't be disengaged. At this time, both the first stoppers (242) and the second stoppers (252) are parallel to the horizontal plane (X). Therefore, the first lid portion (21) is secured to the second lid portion (22), and the accommodating space (11) of the container body (1) is opened for the user to take the object in the accommodating space (11) out.

Although particular embodiments of the present invention have been described in detail for purposes of illustration, various modifications and enhancements may be made without departing from the spirit and scope of the present invention. Accordingly, the present invention is not to be limited except as by the appended claims.

What is claimed is:

1. A storage container, comprising:

a container body, having an accommodating space therein;

a lid, configured to cover the container body, the lid having a raised first lid portion, a raised second lid portion and a hinge portion between the first lid portion and the second lid portion, two sides of the hinge portion being formed with a first inclined surface and a second inclined surface respectively, the first inclined surface being connected to the first lid portion, the second inclined surface being connected to the second lid portion, the first lid portion and the second lid portion being pivotable about the hinge portion as an axis, enabling the first inclined surface and the second inclined surface to lean against each other, the first inclined surface being provided with at least one first engaging unit, an outer wall surface of the first engaging unit being provided with a first stopper, the second inclined surface being provided with at least one second engaging unit corresponding to the first engaging unit, an inner wall surface of the second engaging unit being provided with a second stopper, the second stopper being perpendicular to the first stopper.

2. The storage container as claimed in claim 1, wherein a periphery of the container body is provided with a flange, a bottom of a peripheral edge of the lid is provided with a hook, and the hook is configured to catch an underside of the flange.

3. The storage container as claimed in claim 2, wherein the hook has a wavy surface for increasing a frictional resistance when the hook is pulled.

4. The storage container as claimed in claim 2, wherein one side of the container body is provided with a plurality of mating blocks above the flange, the peripheral edge of the lid is provided with a plurality of mating slots corresponding in position to the mating blocks, and the mating slots are configured to receive the mating blocks, respectively.

5. The storage container as claimed in claim 1, wherein the first engaging unit is an engaging block, and the second engaging unit is an engaging groove.

6. The storage container as claimed in claim 1, wherein the first stopper is parallel to a horizontal plane of the lid, and the second stopper is perpendicular to the horizontal plane.

7. The storage container as claimed in claim 6, wherein the second lid portion is pivotable in the direction of the first lid portion with the hinge portion as the axis, so that the second engaging unit is engaged with the first engaging unit, the second stopper is confined at a position below the first stopper, and both the first stopper and the second stopper are parallel to the horizontal plane.

8. The storage container as claimed in claim 6, wherein the first lid portion is pivotable in the direction of the second lid portion with the hinge portion as the axis, so that the first engaging unit is engaged in the first engaging unit, the first stopper is confined at an inner side of the second stopper, and both the first stopper and the second stopper are perpendicular to the horizontal plane.

9. The storage container as claimed in claim 6, wherein the horizontal plane refers to a horizontal reference plane on which the lid is placed to cover the container body.

10. The storage container as claimed in claim 1, wherein the first stopper is perpendicular to a horizontal plane of the lid, and the second stopper is parallel to the horizontal plane.

11. The storage container as claimed in claim 10, wherein the second lid portion is pivotable in the direction of the first lid portion with the hinge portion as the axis, so that the second engaging unit is engaged with the first engaging unit, the second stopper is confined at an inner side of the first stopper, and both the first stopper and the second stopper are perpendicular to the horizontal plane.

12. The storage container as claimed in claim 10, wherein the first lid portion is pivotable in the direction of the second lid portion with the hinge portion as the axis, so that the first engaging unit is engaged in the first engaging unit, the first stopper is confined at a position below the second stopper, and both the first stopper and the second stopper are parallel to the horizontal plane.

13. The storage container as claimed in claim 10, wherein the horizontal plane refers to a horizontal reference plane on which the lid is placed to cover the container body.

* * * * *